US006669108B2

(12) United States Patent
Boecking

(10) Patent No.: US 6,669,108 B2
(45) Date of Patent: Dec. 30, 2003

(54) PRESSURE-CONTROL INJECTOR FOR INJECTING FUEL WITH A DOUBLE VALVE

(75) Inventor: Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 230 days.

(21) Appl. No.: 10/035,559

(22) Filed: Nov. 7, 2001

(65) Prior Publication Data

US 2002/0104894 A1 Aug. 8, 2002

(30) Foreign Application Priority Data

Nov. 7, 2000 (DE) ..... 100 54 991

(51) Int. Cl.[7] ..... F12M 41/16
(52) U.S. Cl. ..... 239/96; 239/584; 239/533.7
(58) Field of Search ..... 239/88–96, 124, 239/584, 533.7

(56) References Cited

U.S. PATENT DOCUMENTS 4,763,873 A * 8/1988 Phillips ..... 251/30.05
6,092,744 A * 7/2000 Youakim ..... 239/533.2
6,520,157 B2 * 2/2003 Boecking ..... 123/458
6,568,368 B1 * 5/2003 Boecking ..... 123/456

FOREIGN PATENT DOCUMENTS

DE 197 01 879 A1 7/1998
EP 0 657 642 A2 6/1995

* cited by examiner

*Primary Examiner*—Michael Mar
*Assistant Examiner*—Thach H. Bui
(74) *Attorney, Agent, or Firm*—Michael J. Striker

(57) ABSTRACT

A fuel injector for injecting pressure fuel in a combustion chamber of an internal combustion engine has an injector housing, an inlet connectable with a high pressure collecting chamber, a nozzle inlet line, a 2/2-way valve for opening and closing the nozzle inlet line, a control chamber in which a pressure change occurs, at least one first ball valve positioned at a side of the control chamber, at least one second ball valve positioned at a side of the inlet, and a guide element movable in the housing, the first and second ball valve being positioned opposite to one another and associated with the movable guide element.

12 Claims, 1 Drawing Sheet

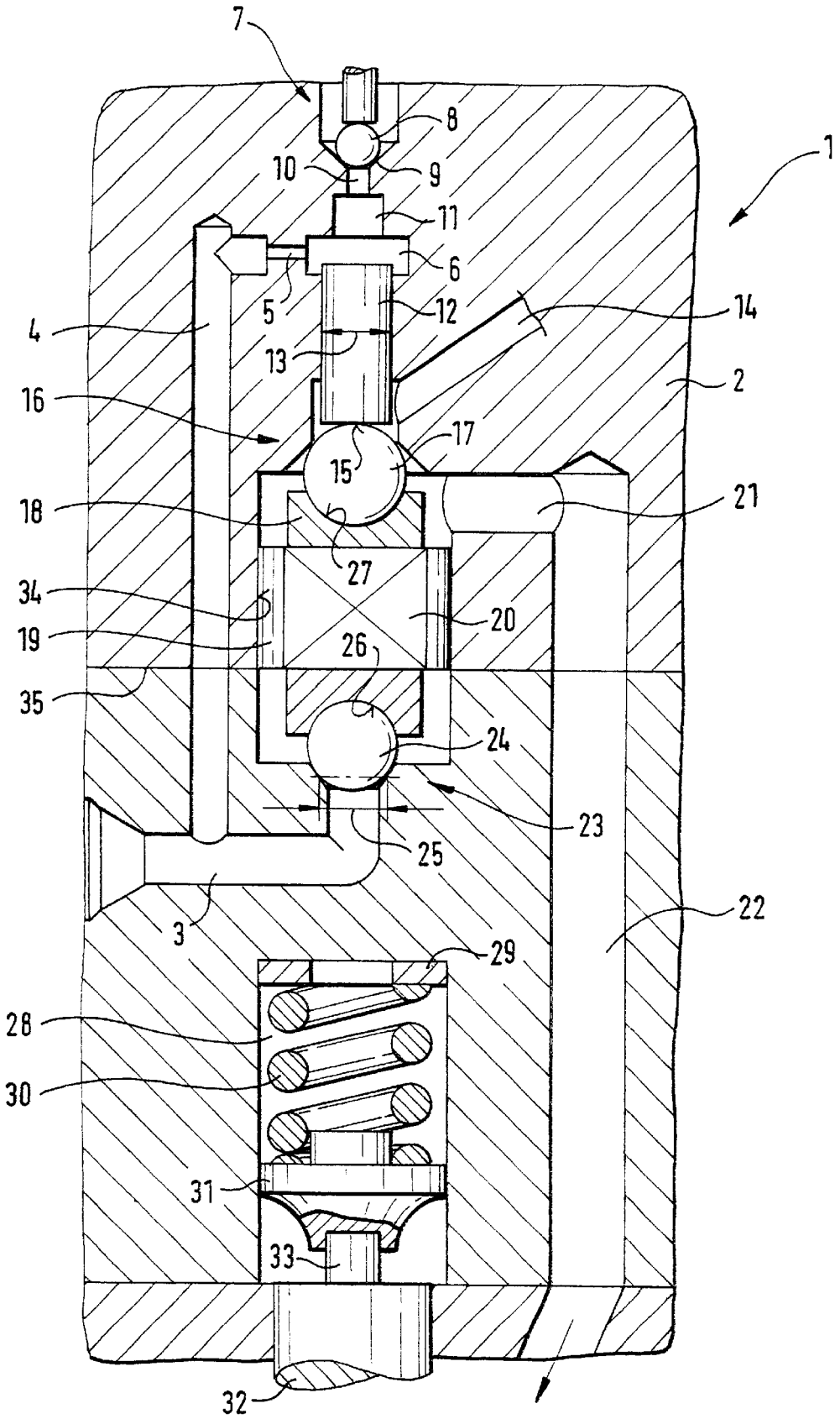
7
8
1
10
9
11
6
5
12
14
4
13
2
16
17
15
21
18
27
34
20
19
26
35
24
23
25
22
3
29
28
30
31
33
32

PRESSURE-CONTROL INJECTOR FOR INJECTING FUEL WITH A DOUBLE VALVE

BACKGROUND OF THE INVENTION

The present invention relates to a pressure-control injector for injecting fuel with a double valve.

The fuel injection systems commonly used for direct injection and internal combustion engines nowadays contain a high-pressure collecting chamber (common rail). In addition to a high pressure collecting chamber the injection system includes injectors which project into a combustion chamber of an internal combustion engine to be supplied with fuel. Upon injection the demand for the fuel quantity to be injected and the starter injection is exceptionally important and must take into consideration the ignition leg. Moreover, the injectors represent mechanically loaded components whose fatigued strength at favorable manufacturing costs must not fall below the service life of the internal combustion engine.

Reference numerals EP 0 657 642 A2 and DE 197 01 879 A1 each disclose a fuel injection device for combustion engines. More specifically, each of these documents describes a fuel injection device that includes a high pressure pump which is assigned to a high pressure accumulating chamber (common rail) that is to be filled with fuel. A high pressure accumulating chamber is connected via injection lines with injection valves projecting into the combustion chamber of the internal combustion engine. The opening or closing movements are controlled respectively by an electrically control valve. The control portion is formed as a 3/2 way valve, which is connected with the injection line or a release line to a high pressure channel opened to an injection opening of the injection valve. A hydraulic working chamber or a pressure release chamber fillable with high pressure fuel is provided on a control member of the control part. The working chamber is controllable for adjustment of the set position of the control member of a release channel. As the case may be, during a pause an injection a connection between the injection valve and the release chamber can be created. Both these devices have a considerable overall height.

SUMMARY OF THE INVENTION

Accordingly, it is an object of present invention to provide a pressure-control injector for injecting fuel with a double valve, which avoids the disadvantages of the prior art.

In contrast to the devices described above, the present invention provides a 3/2-way valve which has a very compact construction and can be produced in a cost effective manner due to the use of ball-shaped bodies. The ball-shaped bodies arranged as ball valves opposite to one another represent simple standard parts, which based on the geometry, allow an optimal pressure distribution of the surface to receive the pressure. In addition, the solution proposed in the present invention makes possible the production of a simply constructed 3/2 valve without the need for relative movements of a seat surface.

The positioning of the balls lying opposite to one another on and supported by a common guide, bring about a self-centering of the balls in their respective ball sockets in a simple manner. Another manufacturing advantage associated with the valve configuration is that the ball sockets lye freely on or on top of the faces of the guide, and by the respective pressure forces take care of the centering itself with reference to a center line of the injector. The ball sockets are composed of a soft metal or a soft metal alloy to facilitate a secure support and to ensure an optimal fitting to the ball surface geometry. Thus, with the configuration of the injector in accordance with the present invention adjusting plate is avoided in the life of the injector, and a centering of the ball sockets and the balls received therein relative to the guide and thereby to the line of symmetry of the injector is realized. The guide which has the ball sockets.

The guide which has the ball sockets on its upper and lower sides is provided with free spaces which permit a longitudinal flow of the pressurized fuel upon pressure release of the control chamber by regulation of a 2/2 valve. A pressure release of the nozzle chamber of the injection nozzle takes place through a pressure release of the nozzle inlet and the pressure chamber connected thereby via the ball valve on the control chamber side to which upon closing of the common rail the nozzle inlet line releases various oil.

With the use of a high pressure receiving chamber line which is angled at 90°, its connection to the injector body is lateral, and the height of the inventive injector is favorably affected or in other words minimized.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is a view showing a longitudinal cross-section through a housing of an injector with ball valves located opposite to one another and supported on a guide and ball sockets for receiving the ball valves, in accordance with the present invention.

DESCRIPTION OF THE PREFERRED EMBODIMENTS

An injector for injecting a high pressure fuel in a combustion chamber of the internal combustion engine shown in FIG. 1 has an injector housing 2 with an inlet 5 coming from a high pressure collecting chamber open beneath a dividing seam 35. For space saving purposes the inlet 3 from the high pressure collecting chamber is formed as a bore extending at an angle of 90°, so that inside the injector housing 2 beneath a guide 19 a hollow chamber 28 can be located in order to create an injector 1 with particularly compact dimensions.

A bore 4 is provided in the injector housing 2 and branches off from the inlet 3 to the high pressure collecting chamber. The bore 4 opens into a control chamber 6 via an inlet throttle 5. These features make possible that in a control chamber 6 a constant and adequate control volume is maintained under high pressure. The control chamber 6 which actuates the vertical movement of the guide 19 is associated with a 2/2-way valve. The 2-2/way valve can be a hydraulic/mechanical regulating unit, a piezo actuator, or a magnetic valve, as is not specifically shown in FIG. 1.

By means of this not shown element which makes possible the advantageous and short response and control time features which are even more important with high rotational speed of the internal combustion engine, a sealing body 8 is pressure-unloaded with a corresponding control. Thereby the sealing body 8 shown here as a ball slides up on its sealing seat 9 and releases an outlet throttle 10 which is located behind a release opening 11 provided above the control chamber 6. The control chamber 6 is balanced by regulation of the 2/2-way valve 7.

By balancing of the control chamber 6 a control chamber piston 12 located opposite to the release opening 11 descends into the control chamber 6. The pole 17 of the ball valve 16 on the control chamber side which lies on a contact point 15 of the control chamber piston 12 moves upwardly and closes off the waste oil line 14 which branches transversely relative to the control chamber piston 12 in the injector housing 2. The control chamber piston 12 is formed with a diameter which exceeds the valve diameter 25 on the ball 24 of the oppositely disposed ball valve 23.

The ball valve 16 provided on the control chamber side as well as the ball valve 23 provided on the high pressure collecting chamber side are received in a hollow chamber provided in the injector housing 2. The hollow chamber is partially filled by a guide 19, wherein ball sockets 18 are provided at oppositely located faces of the guide. The ball sockets 18 are freely movable relative to the faces of the guide 18 and preferably composed of a soft, metallic material or a soft metallic alloy. In addition of the ball sockets 18, a rounded portion 26 or 27 is formed, each of which corresponds to the ball 17 or 24 received in the ball sockets 18.

Based on this construction of the ball sockets 18 composed of soft metal an exact fit of the radius of curvature of the outer surfaces of the balls 17 or 23 with the socket rounded portions 26, 27 in the respective ball socket 18 is realized. In connection with this, the construction of the ball sockets 18 enables the balls 17 or 24 to be sufficiently centered to the socket rounded portions 26, 27 of the ball sockets 18. Furthermore, the selected configuration provides for a self-centering of the ball socket 18 in the balls 17 and 23 relative to the line of symmetry of the injector housing 2. From a manufacturing point of view, the arrangement of the ball sockets on the faces of the guide 19 offers advantages, since the sufficient operational position of the guide is independent from a form-locking connection of the ball sockets 18 with the guide 19 during the operation of the inventive injector.

The guide 19 is provided near a guide area 34 with free surfaces or spaces 20. The guide area 24 serves for guiding the guide 19 free from play in a vertical direction in the hollow chamber in the injector housing 2. The free spaces 20 permit a longitudinal flow of the pressurized fuel along the free spaces 20 of the guide 19 and introduction of the pressurized fuel through the transverse bore in a longitudinal bore 22, which represents the nozzle inlet to the nozzle chamber to the injection nozzle needle. The above-described longitudinal flow occurs upon pressure release of the control chamber 6 in the above described longitudinal flow occurs upon pressure release of the control chamber 6 in the above described manner, or in other words by controlling the actuator elements an opening of the oppositely located valves, of the high pressure receiving chamber 3.

Due to the angled configuration of the inlet 3 to the ball valve 23 on the inlet side, a sealing spring 30 in the hollow chamber 28 can be positioned directly under the inlet 3 from the high pressure collecting chamber in the injection housing 2. The sealing spring 30 in the hollow chamber 23 abuts against a disc-shape member 29 and lies with its opposite ends on a ball shaped pressure member 31. An end of the pressure member 31 receives a pin 33 of the nozzle needle 32, so that the sealing force of the sealing spring 30 on the nozzle needle 32 can be transferred, with the sealing spring 30 pressed in its sealing seat in the area of the injector opening. By regulating of the 2/2 control valves 7 and therefore the pressure release of the control chamber 6, the control chamber piston 12 descends into the control chamber 6. The ball 17 of the ball valve 16 on the control chamber side descends into its sealing seat in the injector housing 2 and closes the waste oil line 14. At the same time the ball 24 of the ball valve 23 located on the lower surface of the guide 19 descends and opens the inlet from the high pressure accumulating chamber. High pressure fuel flows over the inlet 3 into the hollow chamber of the injector housing 2, passes over the free space 20 of the guide 19 and enters into the nozzle inlet 22 through the transverse bore 21. The nozzle inlet 22 drains into a nozzle chamber (not shown in FIG. 1 which surrounds the injector nozzle in front of its injector seat). Its position the waste oil line 14 opposite the high pressure is closed by the ball 17 when it descends into its seat in the injector housing 2.

The ball 24 on the inlet side ball valve 23 is pressed with its valve diameter 25 into its seat in the injector housing upon closing of the inlet 3 from the high pressure collecting chamber. This is performed by an increase of the pressure in the control chamber 6 via the bore and the inlet throttle 5. Since the diameter 13 of the control chamber piston 12 is larger than the valve diameter 25 of the ball valve 23, a downward vertical movement of the guide 19 and the hollow chamber within the injector housing 2 occurs, so that the inlet 3 from the high pressure receiving chamber can be closed. At the same time, the ball 17 of the control chamber side ball valve 16 opens the waste oil line 14. Thus, the nozzle inlet 22 and therefore the nozzle chamber of the injection nozzle can be released by the transverse bore 21 and the upper portion of the hollow chamber of the injector housing 2, so that the pressure fuel can run back into the tank via the waste oil line 14.

The main idea of the present invention therefore resides in two ball-shaped ball valves 16 and 23, each located in a socket 18 of the surface of a guide 19, wherein the valves self center opposite the seat in the injector housing 2. This permits a simple manufacture of the component since the tolerances can be favorably chosen and since the self centering can be automatically adjusted, based on the prevailing pressure during operation in both areas of the hollow chamber within the injector housing 2 containing the guide 19. Therefore this reason a seat surface need not be movable relative to the guide. In addition, the seat surface can be stationary in the injector housing 2 since with the selected geometry of the counter parts, that is the balls 17 and 23, an adaptation to the final structural conditions of the seat surfaces of the injector housing 2 can be precisely determined. Thus, a seal seat without leakage can be achieved with a favorable selected tolerance in the injector housing 3.

It will be understood that each of the elements described above, or two or more together, may also find a useful application in other types of constructions differing from the types described above.

While the invention has been illustrated and described as embodied in pressure-control injector for injecting fuel with a double valve, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A fuel injector for injecting pressure fuel in a combustion chamber of an internal combustion engine, comprising an injector housing; an inlet connectable with a high pressure collecting chamber; a nozzle inlet line; a 2/2-way valve for opening and closing said nozzle inlet line; a control chamber in which a pressure change occurs; at least one first ball valve positioned at a side of said control chamber; at least one second ball valve positioned at a side of said inlet; and a guide element movable in said housing, said first and second ball valve being positioned opposite to one another and associated with said movable guide element.

2. A fuel injector as defined in claim 1, wherein said nozzle inlet line, said control chamber, and a waste oil line are positioned above said guide element, said inlet being positioned below said guide element.

3. A fuel injector as defined in claim 1, wherein said guide element includes guide areas for guiding within a hollow chamber and said injector housing and also free surfaces for receiving a flow of fuel.

4. A fuel injector as defined in claim 1, wherein at least one of said first and second ball valves has balls positioned on two sides of said guide element, said ball being formed as closing and releasing elements and received in ball sockets of said guide element.

5. A fuel injector as defined in claim 4, wherein said ball sockets are freely movable on end surfaces of said guide element.

6. A fuel injector as defined in claim 4, wherein said ball sockets are provided with rounded portions, said rounded portions corresponding to a configuration of said balls.

7. A fuel injector as defined in claim 4, wherein said ball sockets are composed of a material selected from the group consisting of a soft metallic material and a soft metallic alloy.

8. A fuel injector as defined in claim 1, wherein a control chamber piston is provided above said ball valve located at a side of said control chamber, said control chamber being acted upon by a control volume in said control chamber, said control chamber piston having a diameter which exceeds a valve diameter of said ball valve located at a side of said high pressure chamber.

9. A fuel injector as defined in claim 1, wherein upon opening of said inlet from the high pressure collecting chamber, said nozzle inlet line to a waste oil line closes.

10. A fuel injector as defined in claim 1, wherein said inlet from the high pressure collecting chamber is closed by said ball valve located at a side of said high pressure chamber, said nozzle inlet to a waste oil line is releasable by said ball valve located at a side of said control chamber.

11. A fuel injector as defined in claim 1, wherein said inlet from said high pressure collecting chamber is formed as a 90°-angled bore with an aperture in a hollow chamber in said injector housing closeable or openable by a seat diameter of said ball valve located at a side of said high pressure chamber.

12. A fuel injector as defined in claim 7, wherein said soft metallic material is a material selected from the group consisting of bronze and brass.

* * * * *